US007928331B2

(12) United States Patent
Lee

(10) Patent No.: US 7,928,331 B2
(45) Date of Patent: Apr. 19, 2011

(54) SWITCHING APPARATUS OF DISPENSER FOR REFRIGERATOR

(75) Inventor: Chang-Lim Lee, Masan (KR)

(73) Assignee: LG Electronics Inc., Seoul (KR)

( * ) Notice: Subject to any disclaimer, the term of this patent is extended or adjusted under 35 U.S.C. 154(b) by 288 days.

(21) Appl. No.: 12/296,879

(22) PCT Filed: Mar. 19, 2007

(86) PCT No.: PCT/KR2007/001339

§ 371 (c)(1),
(2), (4) Date: Oct. 10, 2008

(87) PCT Pub. No.: WO2007/119931

PCT Pub. Date: Oct. 25, 2007

(65) Prior Publication Data

US 2009/0056363 A1 Mar. 5, 2009

(30) Foreign Application Priority Data

Apr. 14, 2006 (KR) ..... 10-2006-0034218

(51) Int. Cl.
*H01H 9/06* (2006.01)

(52) U.S. Cl. ..... 200/61.86

(58) Field of Classification Search ..... 200/52 R, 200/61.41, 61.58 R, 61.86, 406–408, 512, 200/517, 330; 141/351–362; 62/344, 389–391
See application file for complete search history.

(56) References Cited

U.S. PATENT DOCUMENTS

| | | | | |
|---|---|---|---|---|
| 4,209,999 | A * | 7/1980 | Falk et al. | 200/61.7 |
| 4,254,311 | A | 3/1981 | Sisk, Jr. | |
| 6,135,173 | A * | 10/2000 | Lee et al. | 141/361 |
| 2004/0188466 | A1 | 9/2004 | Choi | |
| 2006/0201194 | A1 * | 9/2006 | Bowen et al. | 62/389 |
| 2008/0168782 | A1 * | 7/2008 | Kavchale et al. | 62/344 |

FOREIGN PATENT DOCUMENTS

| | | | |
|---|---|---|---|
| CN | 1061300 | A | 5/1992 |
| JP | 04-160712 | A | 6/1992 |
| KR | 20-0130588 | Y1 | 1/1999 |
| KR | 20-0152159 | Y1 | 7/1999 |

* cited by examiner

*Primary Examiner* — Felix O Figueroa
(74) *Attorney, Agent, or Firm* — Birch, Stewart, Kolasch & Birch, LLP

(57) ABSTRACT

A switching apparatus of a dispenser for a refrigerator includes a switch for providing a signal to control discharge of an object from the dispenser provided on a refrigerator door and a switch actuating portion for switching on or off the switch. Further, the switch actuating portion is elastically deformed and at least one end of the switch actuating portion is moved in a direction perpendicularly to a driving force to switch on the switch when the driving force is applied thereto to discharge the object, and the switch actuating portion is restored to switch off the switch when the driving force is removed. According to the switching apparatus so configured, since a user does not have to pivot an actuating lever to take water in a vessel, a space occupied by the dispenser in the door is decreased, and thus, an internal storage space in the refrigerator can be sufficiently secured.

4 Claims, 6 Drawing Sheets

SWITCHING APPARATUS OF DISPENSER FOR REFRIGERATOR

The present invention relates to a dispenser for a refrigerator, and more particularly, to a switching apparatus of a dispenser for a refrigerator.

BACKGROUND OF THE INVENTION

Generally, a refrigerator is one of daily necessaries, i.e. an appliance in which food can be kept at a fresh state for a long time or can be frozen by lowering an inside temperature using a refrigerant that repeatedly undergoes a refrigeration cycle of compression-condensation-expansion-evaporation.

A currently available large-sized refrigerator is provided with a dispenser for allowing ice or water stored in the refrigerator to be taken out without opening a refrigerator door. Therefore, such a dispenser can prevent cold air in a refrigerator from escaping to the outside and contribute to the convenience of a user.

In a general refrigerator provided with a dispenser as shown in FIG. 1, a dispenser 3 is mounted onto a front surface of a refrigerator door 2.

Further, the dispenser 3 includes an actuating layer 5 for operating to discharge water and ice, a water trough 7 provided on the lower side thereof, and a discharge portion 9 corresponding to a water supplying space.

FIG. 2 schematically illustrates the configuration of a conventional dispenser 3. Referring to this figure, a switch 17 for applying electric power to supply water is provided at a position corresponding to an upper portion of the actuating lever 5, and the actuating lever 5 is pivoted about a hinge axis 18 in a front and rear direction within a radius of operation. At this time, when a lower end of the actuating lever 5 is pivoted rearward by an external force, an upper end of the actuating lever 5 is pivoted forward about the hinge axis 18 to operate the switch 17.

The aforementioned dispenser 3 is configured in such a manner that if a user inserts a vessel 19 for containing water into the discharge portion 9 and also pushes the actuating lever 5, both electrodes of the switch 17 are connected with each other and electric power is then applied to a pump 16.

If the electric power is applied to the pump 16, a suction force is generated such that water stored in a water tank (not shown) is discharged through a discharge port 15 and then filled into the vessel 19.

On the other hand, if a force pressing the actuating lever 5 is removed, the actuating lever 5 is restored to its original position by an elastic member (not shown) and the switch 17 is disconnected. Therefore, the operation of the pump 16 is stopped, and thus, the discharge of water through the discharge port 15 is terminated.

However, such a switching structure of a conventional dispenser has the following problems.

That is, if a user intends to take water in the vessel 19 using the dispenser 3 mounted with the actuating lever 5, he/she should push the vessel 19 into the water supplying space by a certain distance and pivot the actuating lever 5. At this time, if the length L of the actuating lever 5 becomes shorter, a radius of rotation S is decreased but a relatively large external force is required. On the contrary, if the length L of the actuating lever 5 becomes longer, a relatively small external force is enough to pivot the actuating lever 5 but a radius of rotation S is increased. Accordingly, since a space sufficient to pivot the actuating lever 5 is necessary in the discharge portion 9, a total space occupied by the dispenser 3 is increased, and thus, a storage space in a refrigerator will be reduced.

BRIEF SUMMARY OF THE INVENTION

The present invention is conceived to solve the aforementioned problems in the prior art. An object of the present invention is to provide a dispenser capable of sufficiently securing a storage space.

According to an aspect of the present invention for achieving the object, there is provided a switching apparatus of a dispenser for a refrigerator, comprising a switch for providing a signal to control discharge of an object from the dispenser provided on a refrigerator door, and a switch actuating portion for switching on or off the switch. Further, the switch actuating portion is elastically deformed and at least one end of the switch actuating portion is moved in a direction perpendicularly to a driving force to switch on the switch when the driving force is applied thereto to discharge the object, and the switch actuating portion is restored to switch off the switch when the driving force is removed.

The switch actuating portion may be a leaf spring formed into an arch shape having a predetermined curvature.

Preferably, one end of the switch actuating portion is supported on a support end formed on one side of a dispenser frame constituting an external appearance of the dispenser, and the other end of the switch actuating portion is connected with the switch.

The switch actuating portion may be covered with a button pad provided within a recessed portion of the dispenser frame.

Further, the button pad may be formed of a flexible material.

According to the switching apparatus of the present invention so configured, it is not necessary for a user to push a vessel and pivot an actuating lever to take water in the vessel. Therefore, a space occupied by a dispenser is decreased, and thus, a storage space in a refrigerator can be sufficiently secured.

DETAILED DESCRIPTION OF THE INVENTION

Hereinafter, a preferred embodiment of a switching apparatus of a dispenser for a refrigerator according to the present invention will be described in detail with reference to the accompanying drawings.

Figure 1:
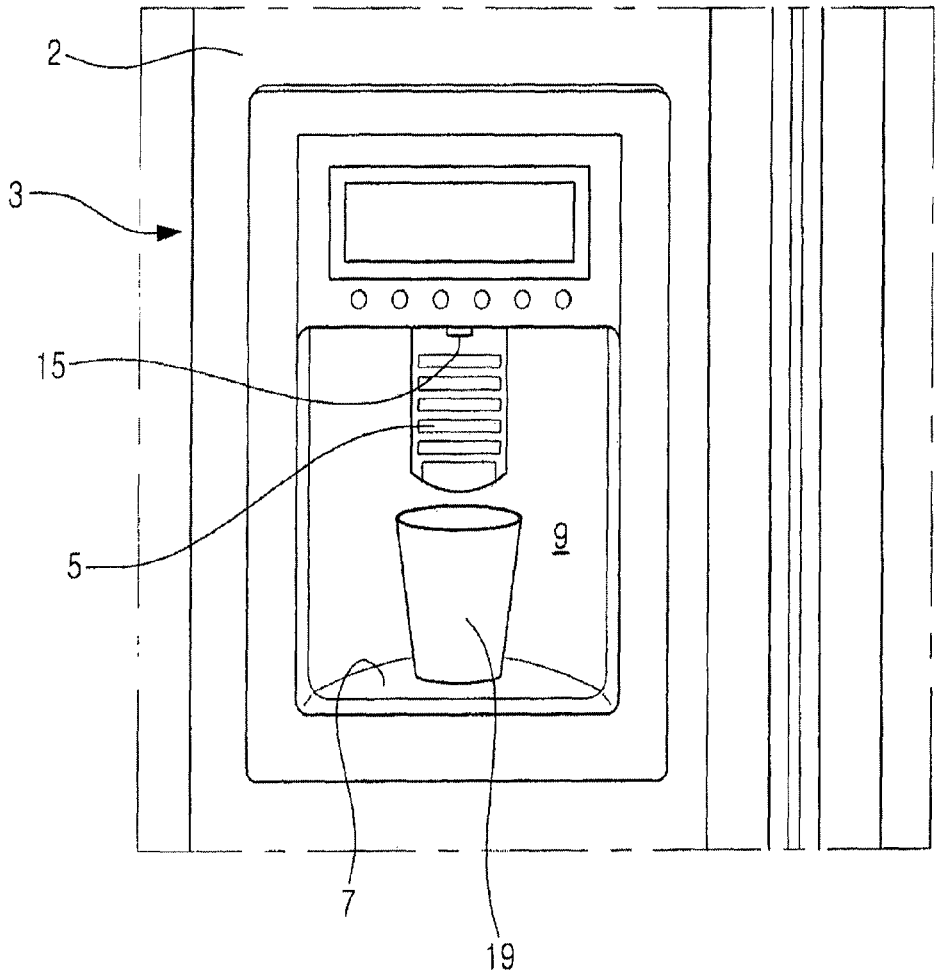
FIG. 1 is a front view illustrating a general refrigerator with a conventional dispenser.
Figure 2:
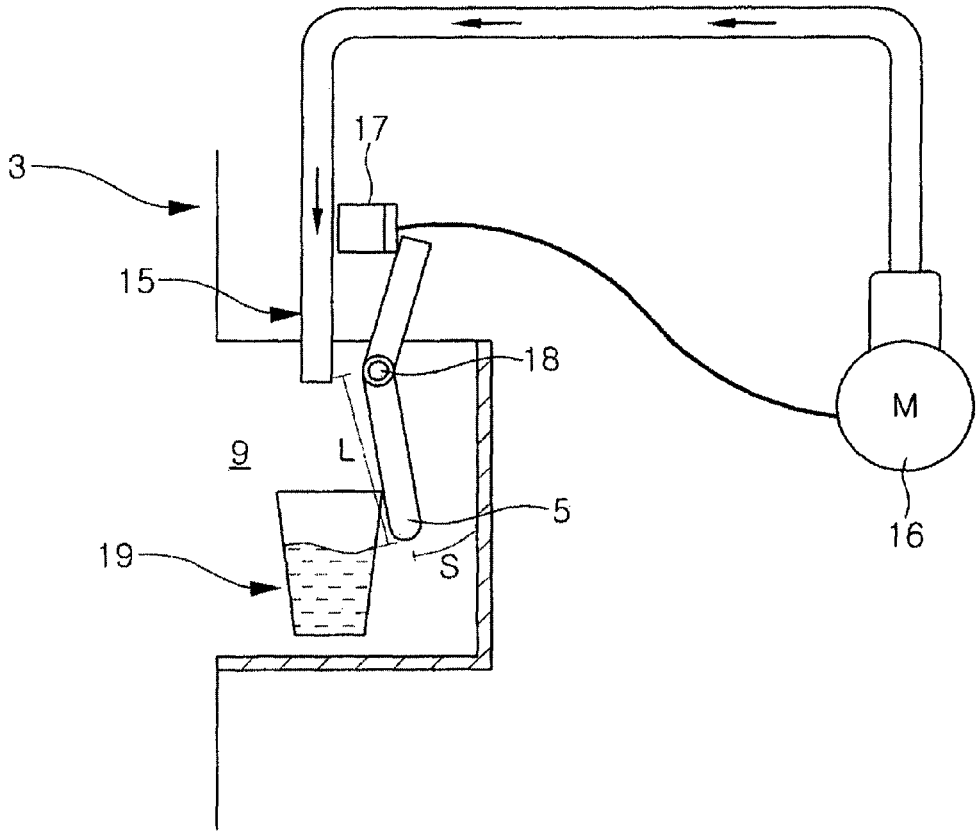
FIG. 2 is a side sectional view of a conventional dispenser.
Figure 3:
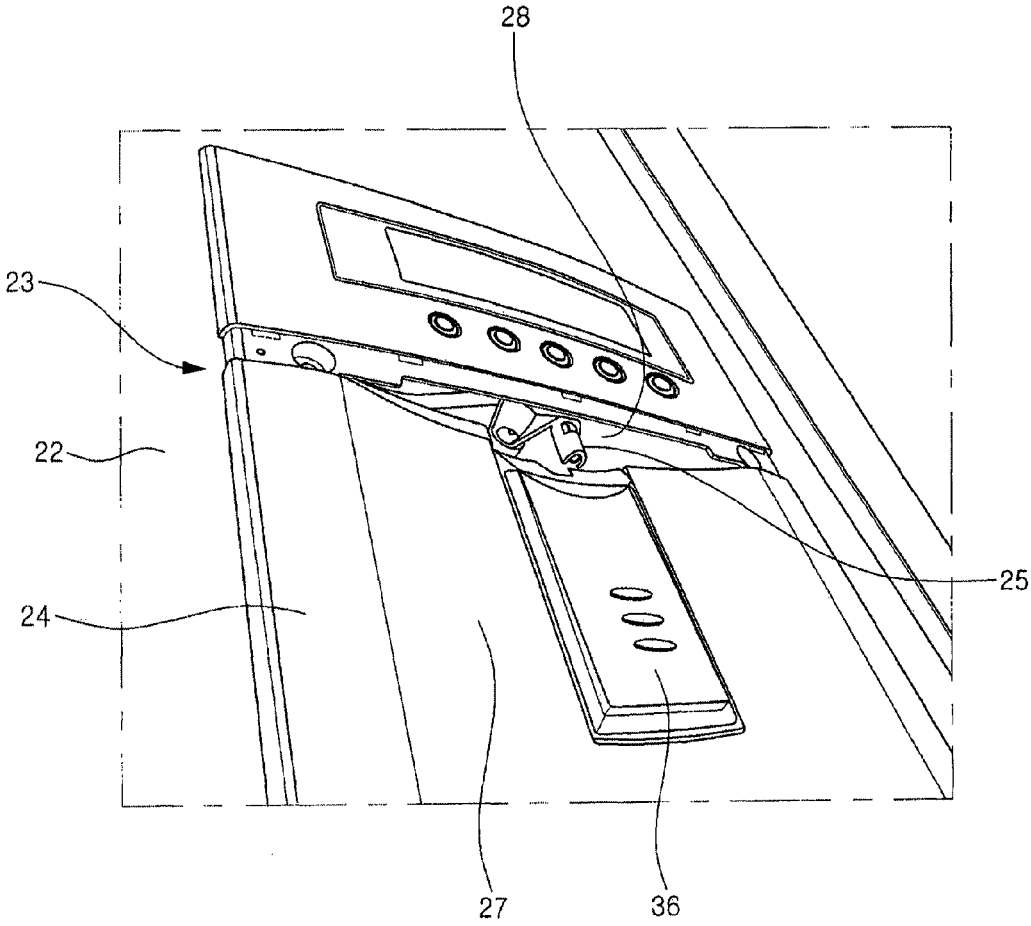
FIG. 3 is a perspective view illustrating a preferred embodiment of a dispenser for a refrigerator provided with a switching apparatus according to the present invention.
Figure 4:
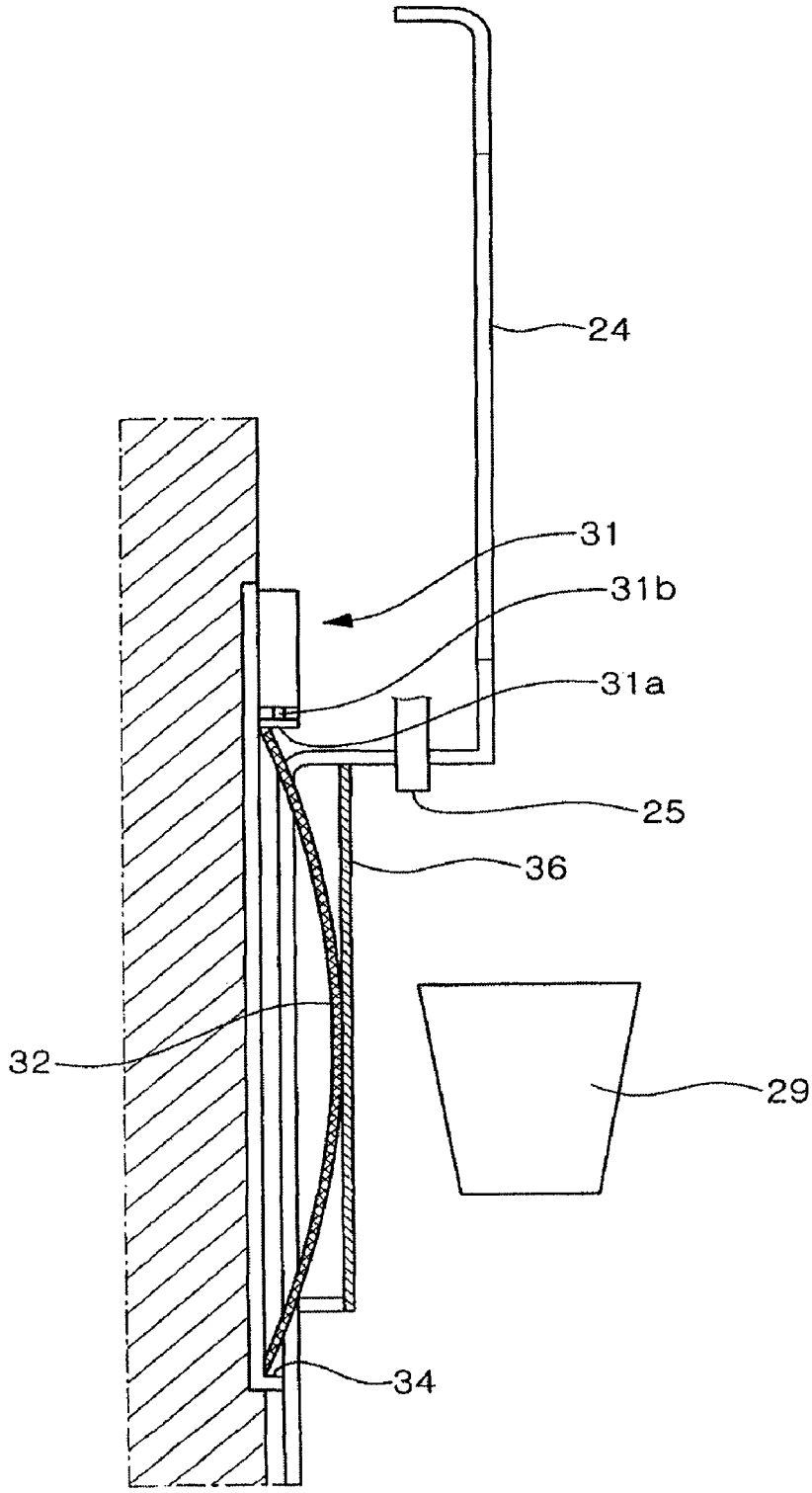
FIG. 4 is a side sectional view illustrating a preferred embodiment of the present invention.
Figure 5:
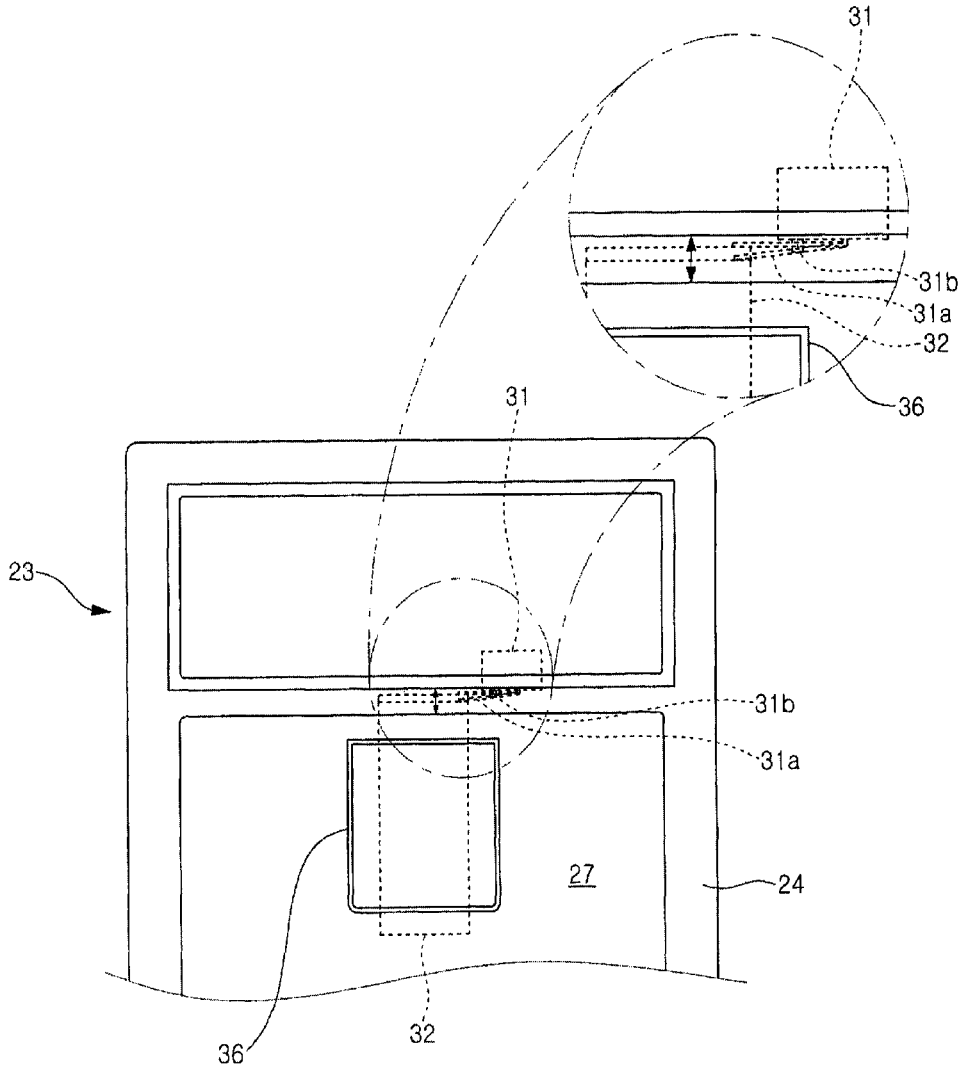
FIG. 5 is a partially enlarged view illustrating the switching apparatus according to an embodiment of the present invention.

FIG. 3 shows a refrigerator provided with a dispenser according to the present invention, FIG. 4 is a side sectional view illustrating a preferred embodiment of the dispenser according to the present invention, and FIG. 5 is a front sectional view illustrating an embodiment of the present invention.

As shown in the figures, a dispenser 23 capable of taking out an object such as water or ice stored in a refrigerator from the outside is provided in a front surface of a refrigerator door 22. An external appearance of the dispenser 23 is defined by a dispenser frame 24. Here, an upper portion of the dispenser frame 24 is provided with a discharge port 25 through which water is discharged, and a switching apparatus to be described later is installed within the dispenser frame 24.

At this time, the dispenser frame 24 includes a recessed portion 27 that is rounded inwardly. An opening 28 that is open in a vertical direction is formed above the recessed portion 27. The discharge port 25 extends into the recessed portion 27 through the through portion 28.

Meanwhile, the configuration of the switching apparatus provided at an upper position of the recessed portion 27 of the dispenser frame 24 is illustrated in detail in a side sectional view of FIG. 4.

Referring to FIG. 4, the switching apparatus comprises a switch 31 and a switch actuating portion 32 for actuating the switch 31.

The switch 31 is provided within the dispenser frame 24. In the present embodiment, the switch is provided at an upper position within the dispenser frame 24.

As shown in FIG. 5, an upwardly and downwardly operating lever 31*a* and a push protrusion 31*b* are provided at a lower end of the switch 31. The lever 31*a* is installed in such a manner that one end thereof is brought into contact with an upper end of the switch actuating portion 32. If the upper end of the switch actuating portion 32 is slid upwardly, the lever 31*a* is moved upwardly together with the switch actuating portion to lift the push protrusion 31*b* and thus to switch the switch 31 on. At this time, the push protrusion 31*b* is provided with a movable contact, and the switch 31 is provided with a fixed contact which is selectively brought into contact with the movable contact. Alternatively, the upper end of the switch actuating portion 32 can serve as a movable contact and then come into contact with a fixed contact provided within the switch 31 to switch on the switch 31.

The switch actuating portion 32 is formed such that a portion thereof protrudes forward of the dispenser frame 24. In the present embodiment, the switch actuating portion is formed into an arch shape with a predetermined curvature. If a driving force is applied to the switch actuating portion 32 in a direction in which the dispenser frame 24 is pressed inwardly, the switch actuating portion 32 is elastically deformed to allow one end thereof to be moved perpendicularly to the driving force such that the switch 31 can be switched on. If the driving force is removed, the switch actuating portion is restored to its original state such that the switch 31 can be switched off. Therefore, the switch actuating portion 32 may be formed into an elastic member with a restoring force, for example, a leaf spring.

At this time, one end of the switch actuating portion 32 is supported on a support end 34 formed on one side of the dispenser frame 24 and the other end thereof is connected with the switch 31. That is, if a driving force pressing the dispenser frame 24 is applied to the switch actuating portion, the other end of the switch actuating portion is moved perpendicularly to the driving force to lift the lever 31*a* provided on the lower end of the switch 31. The support end 34 is recessed at a position of the dispenser frame 24 to allow one end of the switch actuating portion 32 from being separated.

In addition, a button pad 36 is further provided on an inner side of the recessed portion 27 of the dispenser frame 24. A rear surface of the button pad 36 is brought into contact with a portion of the switch actuating portion 32 protruding in a front direction thereof. At this time, the button pad 36 is formed on the front surface of the dispenser frame 24 into a plate shape to cover the switch actuating portion 32, so that the button pad 36 can provide a beautiful external appearance and prevent water from entering the switching apparatus in the process of supplying water.

At this time, the button pad 36 is formed of a flexible material such as a synthetic resin or rubber. That is, the button pad is configured such that it is deformed when a driving force is applied thereto and is restored to its original state when a driving force is removed.

Hereinafter, the operation of a switching apparatus of a dispenser for a refrigerator according to the present invention will be described in detail.

Figure 6:
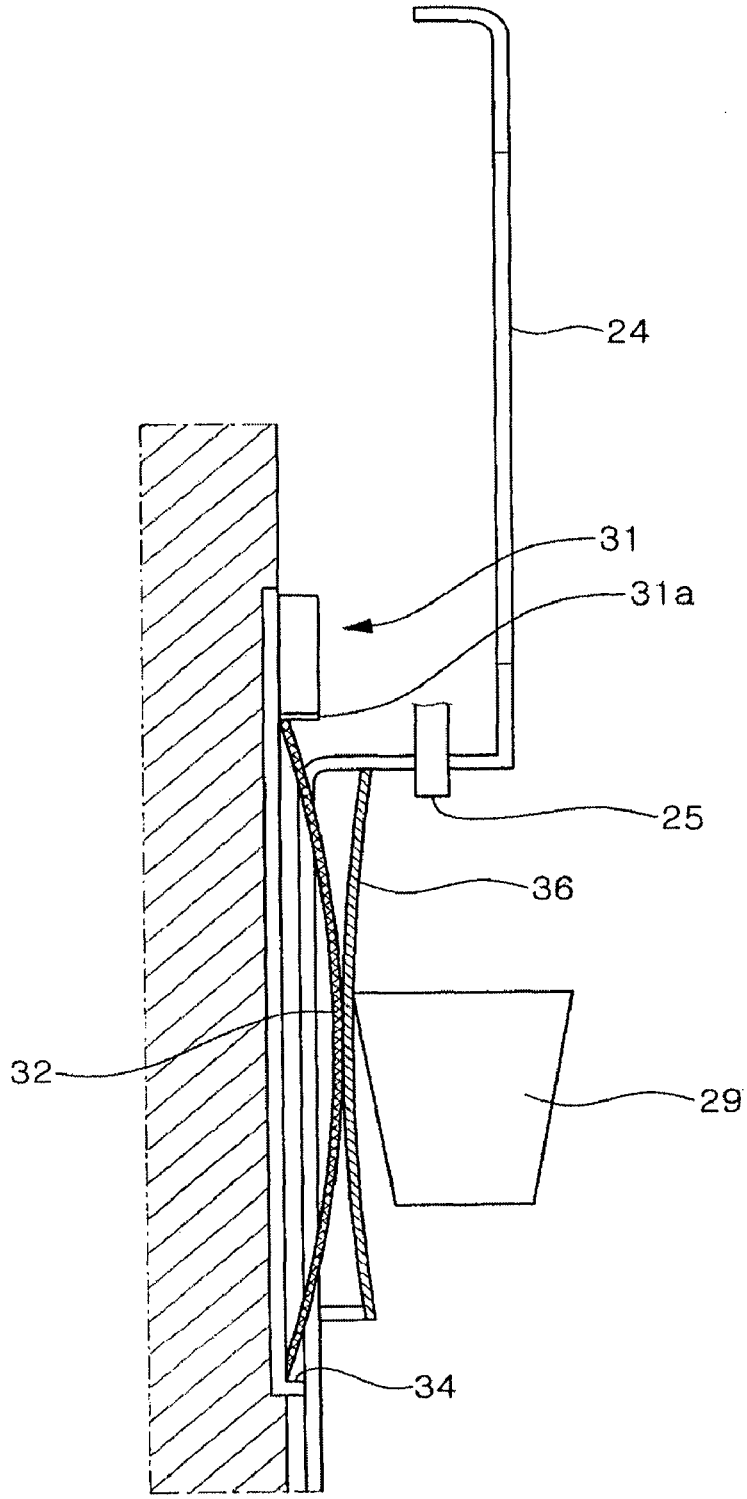
FIG. 6 is a view illustrating an operation state of an embodiment shown in FIG. 4.

First, as shown in FIG. 6, if a user pushes the button pad 36 with a vessel 29, the button pad 36 is pushed rearward and the switch actuating portion 32 which is brought into contact with the button pad 36 is also pushed inwardly of the dispenser frame 24.

If the switch actuating portion 32 is pushed inwardly of the dispenser frame 24 as described above, a protruding portion of the switch actuating portion 32 is withdrawn and the switch actuating portion 32 is flattened as a whole such that one end of the switch actuating portion is slid perpendicularly to a driving force. Thus, the lever 31*a* brought into contact with one end of the switch actuating portion 32 is lifted and pushes upward the push protrusion 32*b* provided on the lower end of the switch 31, so that the switch 31 is switched on. That is, a movable contact point provided on one side of the push protrusion 31*b* comes into contact with a fixed contact provided on the switch 31, so that the electric power can be applied. Alternatively, one end of the switch actuating portion 32 can serve as a movable contact and come into contact with the fixed contact provided on the switch 31. In other words, a fore-and-aft motion is converted into an up-and-down motion by the switch actuating portion 32 such that the switch 31 can be operated.

If the electric power is applied, a water supply valve is operated and a water tank (not shown) is then opened. If the water tank is opened, water flows along a water supply pipe and is dispensed to the vessel 29 through the discharge port 25 connected with the water tank.

Further, if the vessel 29 filled with a desired amount of water is withdrawn, the button pad 36 which has been urged rearward is restored to its original state and the switch actuating portion 32 is also restored due to its elasticity. Accordingly, one end of the switch actuating portion 32 is again slid downward in a direction perpendicular to a direction in which a driving force is applied, and the push protrusion 31*b* which has been pressed by the lever 31*a* is restored and the switch 31 is thus switched off, so that the supply of water is stopped.

While the present invention has been illustrated and described in connection with the accompanying drawings and the preferred embodiment, the present invention is not limited thereto and is defined by the appended claims. Therefore, it will be understood by those skilled in the art that various modifications and changes can be made thereto without departing from the spirit and scope of the invention defined by the appended claims.

For example, the switch 31 may be provided at a lower position of the dispenser frame 24 and may be operated by the lower end of the switch actuating portion 32. Alternatively, the switch 31 may be provided with a lever 31*a* which is moved in a right and left direction and be positioned at the right or left side of the dispenser frame 24, so that the switch actuating portion 32 can be flattened in the right and left direction by a driving force.

According to the present invention, there is provided a switching apparatus which converts a fore-and-aft motion into an up-and-down motion using elastic deformation of a switch actuating portion to allow water to be dispensed from a dispenser. That is, since it is not necessary to pivot an actuating lever, a portion recessed in a rearward direction is decreased. Therefore, there are advantages in that a space occupied by a dispenser in a refrigerator door can be decreased and a sufficient storage space in a refrigerator body can be secured.

Further, since it is not necessary to pivot the actuating lever, a recessed portion of a refrigerator door is relatively smaller and a dispenser can be designed to have a slim structure. Therefore, more beautiful external appearance of a refrigerator can be obtained. In consideration of the recent trend that consumers attach great importance to the design of electronic home appliances, it is very pleasing to the consumers.

The invention claimed is:

1. A switching apparatus of a dispenser for a refrigerator, comprising:

a switch for providing a signal to control discharge of an object from the dispenser provided on a refrigerator door; and a switch actuating portion for switching on or off the switch, wherein the switch actuating portion is elastically deformed and at least one end of the switch actuating portion is moved in a direction perpendicularly to a driving force to switch on the switch when the driving force is applied thereto to discharge the object, and the switch actuating portion is restored to switch off the switch when the driving force is removed, wherein the switch actuating portion is a leaf spring formed into an arch shape having a predetermined curvature.

2. The apparatus as claimed in claim 1, wherein one end of the switch actuating portion is supported on a support end formed on one side of a dispenser frame constituting an external appearance of the dispenser, and the other end of the switch actuating portion is connected with the switch.

3. The apparatus as claimed in claim 2, wherein the switch actuating portion is covered with a button pad provided within a recessed portion of the dispenser frame.

4. The apparatus as claimed in claim 3, wherein the button pad is formed of a flexible material.

* * * * *